US006254692B1

(12) United States Patent
Cooper

(10) Patent No.: US 6,254,692 B1
(45) **Date of Patent: *Jul. 3, 2001**

(54) CAN TOP CLEANING METHOD

(76) Inventor: Byron W. Cooper, 1910 Messina Dr., San Jose, CA (US) 95132

( * ) Notice: Subject to any disclaimer, the term of this patent is extended or adjusted under 35 U.S.C. 154(b) by 0 days.

This patent is subject to a terminal disclaimer.

(21) Appl. No.: 09/592,139

(22) Filed: Jun. 12, 2000

Related U.S. Application Data

(60) Continuation of application No. 09/343,495, filed on Jun. 30, 1999, now Pat. No. 6,090,215, which is a division of application No. 09/063,759, filed on Apr. 21, 1998, now Pat. No. 5,996,169.

(51) Int. Cl.[7] ..... A47L 25/00; B08B 7/00
(52) U.S. Cl. ..... 134/6; 134/42; 15/257.01
(58) Field of Search ..... 134/6, 42; 15/257.01

(56) References Cited

U.S. PATENT DOCUMENTS

| | | | |
|---|---|---|---|
| 2,323,621 | 7/1943 | Penney | 7/151 |
| 2,514,566 | 7/1950 | Capriccio | 7/151 |
| 3,604,047 | 9/1971 | Hennigan | 15/236.09 |
| 4,207,781 | 6/1980 | Greenwood | 81/3.55 |
| 4,651,890 | 3/1987 | Coker et al. | 220/85 |
| 4,733,423 | 3/1988 | Blatt | 15/160 |
| 4,749,080 | 6/1988 | Toohey | 206/210 |
| 4,813,091 | 3/1989 | Glasener | 15/160 |
| 4,875,247 | 10/1989 | Berg | 15/104.94 |
| 4,912,801 | 4/1990 | Hammill | 15/160 |
| 4,951,344 | 8/1990 | Alkhato | 15/257.01 |
| 4,967,622 | 11/1990 | Phillips | 81/3.55 |
| 4,998,984 | 3/1991 | McClendon | 206/205 |
| 5,031,264 | 7/1991 | Muster | 15/104.93 |
| 5,045,116 | 9/1991 | Cohen | 134/6 |
| 5,141,803 | 8/1992 | Pregozen | 442/123 |
| 5,244,111 | 9/1993 | Merom | 220/694 |
| 5,371,913 | 12/1994 | Smith | 15/104.94 |
| 5,555,778 | 9/1996 | Otters et al. | 81/3.55 |
| 5,664,677 | 9/1997 | O'Conner | 206/812 |
| 5,762,948 | 6/1998 | Blackburn et al. | 424/404 |
| 6,016,915 | 1/2000 | Almond . | |
| 6,090,215 * | 7/2000 | Cooper | 134/6 |

FOREIGN PATENT DOCUMENTS

| | | | |
|---|---|---|---|
| 2000040 | 10/1995 | (CA) | 15/118 |
| 2010381 | 9/1971 | (DE) | 81/3.55 |
| 0953303 | 11/1999 | (EP) . | |
| 92/21239 | 12/1992 | (WO) . | |

OTHER PUBLICATIONS

Hillyard Industries; H–101 Technical Data and Material Data Safety Sheet prepared Feb. 8, 1994.

* cited by examiner

*Primary Examiner*—Zeinab El-Arini

(57) ABSTRACT

A method of using a disposable moist towelette to clean and sanitize a top surface and a tight circumferential groove on the top of a pop top beverage can wherein the towelette is moistened with a liquid which does not leave a residue with a perceptible odor or taste after using the moistened towelette to clean the top surface and circumferential groove on the beverage can. The method includes the steps of storing a moist towelette in a sealed disposable packet; removing the moist towelette from the packet; placing the moist towelette on the top of the pop top beverage can; forcing a portion of the moist towelette into the groove on the top of the beverage can; and applying pressure to the moist towelette while manipulating the moist towelette to clean the top surface and groove on the can.

4 Claims, 3 Drawing Sheets

CAN TOP CLEANING METHOD

CROSS-REFERENCES TO RELATED APPLICATIONS

This application is a continuation of application Ser. No. 09/343,495, filed Jun. 30, 1999, U.S. Pat. No. 6,090,215 which is a divisional of application Ser. No. 09/063,759, filed Apr. 21, 1998, for CAN TOP CLEANING DEVICE, U.S. Pat. No. 5,996,169, and this application is related to application Ser. No. 09/343,433 filed Jun. 30, 1999, pending the disclosures of which are incorporated herein by this reference.

BACKGROUND OF THE INVENTION

The present invention relates to a cleaning method and more particularly, to a convenient method for cleaning the top surface and groove on pop top beverage cans using a moist towelette.

Pop top cans are well known and widely used for the storage and consumption of soft drinks and other cold beverages. The popularity of the non-breakable air-tight can is due in part to its convenience as a means for storing and consuming small quantities of carbonated beverages. However, the cans often become contaminated with dirt and other debris during packaging, storage and transportation to retail outlets and vending machines where they are purchased by the consumer. The present design of these cans allows such contaminants to accumulate in a tight groove on the top of the can.

The tight groove on the top of pop top cans is not easily or conveniently cleaned. It is common for consumers to purchase beverages in pop top cans from convenience stores and vending machines and immediately consume the contents therefrom, ingesting portions of the contaminants.

SUMMARY OF THE INVENTION

The present invention is directed to a can cleaning method for cleaning the top surface and groove on pop top cans. In particular, the invention is directed to the use of a moist towelette.

Accordingly, the present invention provides a novel and expedient method using a towelette for cleaning the top surface and groove on pop top cans or similar containers. The towelette is small enough to be placed in clothing pockets, a purse, or other convenient place where the towelette would be available for immediate use. The packaged moist towelette is most effective in cleaning the top surface and groove on pop top cans and can be attached to a pop top can for convenient dispensing from vending machines.

Other features and advantages of the invention will appear from the following description in which the preferred embodiments have been set forth in detail in conjunction with the accompanying drawings however, the invention is not limited to these specific embodiments.

DESCRIPTION OF THE SPECIFIC EMBODIMENTS

Figure 1:
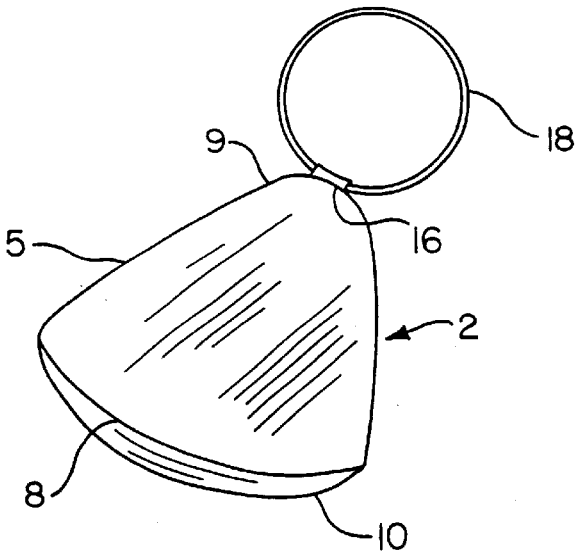
FIG. 1 is a perspective top view of a can cleaning device having a key ring for use with a moist towelette.

Referring to FIGS. 1 to 5, there is illustrated the can cleaning device, generally designated by reference numeral 2, which may be used with the moist towelette of the present invention. A preferred embodiment of can cleaning device 2 is shown in FIG. 1 being generally triangular in shape and having a main body 5, a front edge 8, and a wall 10 depending from front edge 8.

Figure 3:
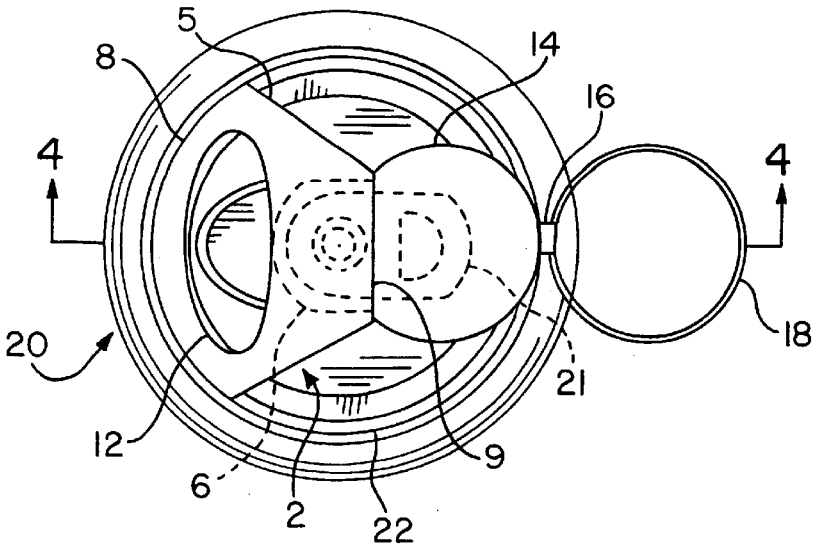
FIG. 3 is a planer top view of a pop top can, and a can cleaning device having a handle, bottle opener, and key ring for use with a moist towelette.
Figure 4:
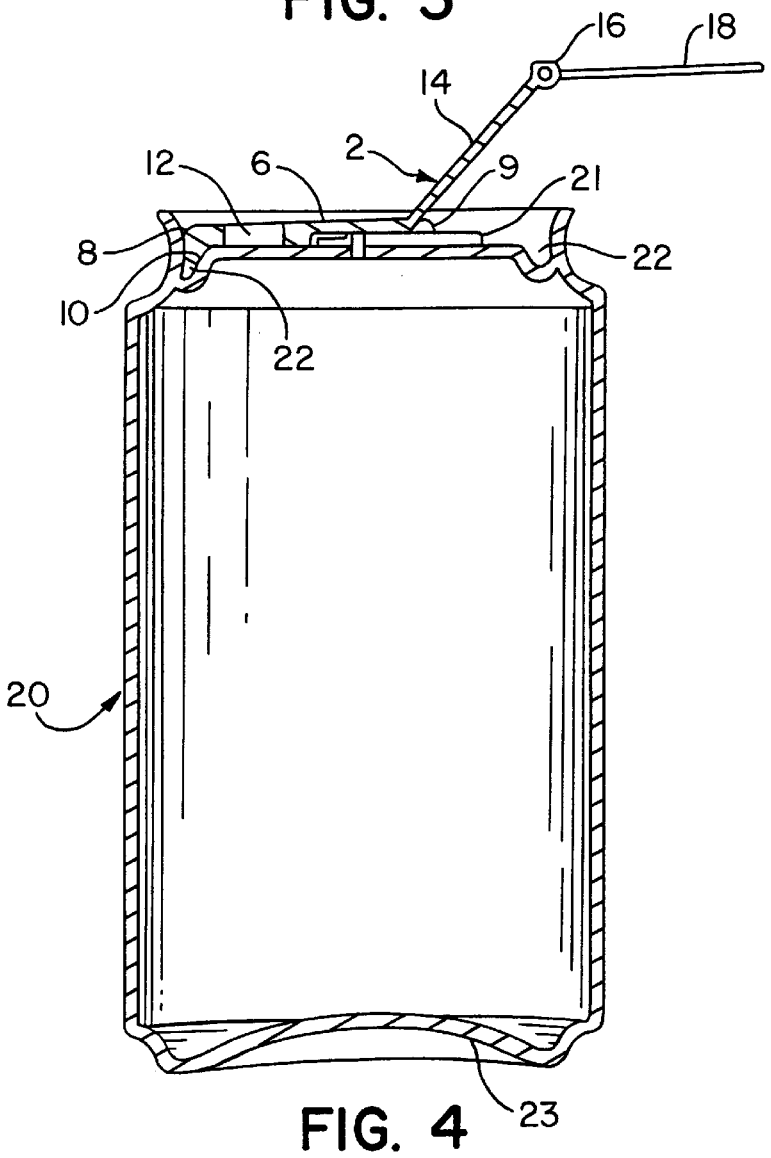
FIG. 4 is a cross sectional view of a pop top can and a can cleaning device taken along line 4—4 of FIG. 3.
Figure 5:
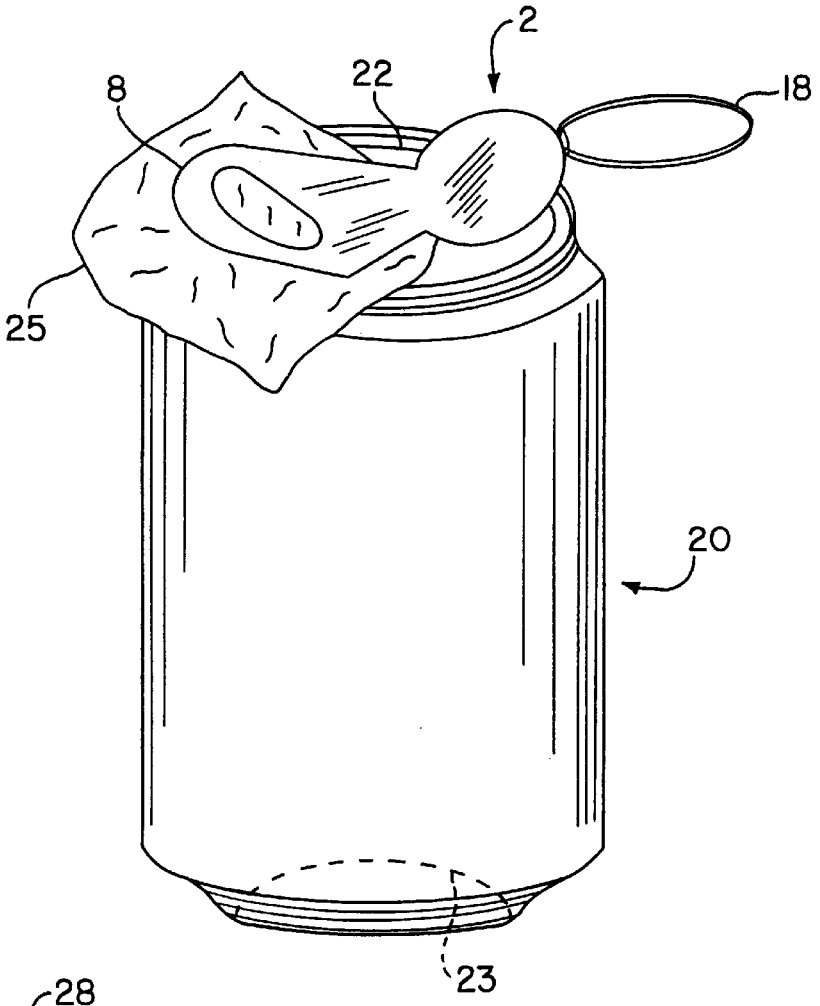
FIG. 5 is a perspective view of a pop top can with a towelette in position according to the invention.

The can cleaning device for use with the present invention may take any general shape. However, the curvature of front edge 8 is designed to conform to the radial curvature of a pop top can 20 as can be seen in FIGS. 3, 4 and 5. The arc distance of front edge 8 can be more than one-half the circumference of the pop top can however, it has been found with respect to overall size and ease of use of the can cleaning device that the circumference of front edge 8 be less than one-half the circumference of can 20. Depending downwardly from front edge 8 is a wall 10 which is shaped to fit into a groove 22 on the top of can 20 as can best be seen in FIG. 4.

Referring to FIGS. 1, 4 and 5, embodiments of cleaning device 2 have a handle 14 (FIGS. 4, 5) attached to main body 5 at a back edge 9 or may have a key ring 18, a chain, cable, string, or similar device attached to main body 5 (FIG. 1) or handle 14 (FIGS. 4, 5) for ease of carrying and use, or for securing the device to a counter top, vending machine or other place where pop top cans are purchased for immediate consumption of their contents. Key ring 18, a chain, cable, string, or similar device, may be attached to main body 5 (FIG. 1) or handle 14 (FIGS. 4, 5) by a ring holder 16 or may be attached by drilling a hole directly into main body 5 or handle 14.

Figure 2:
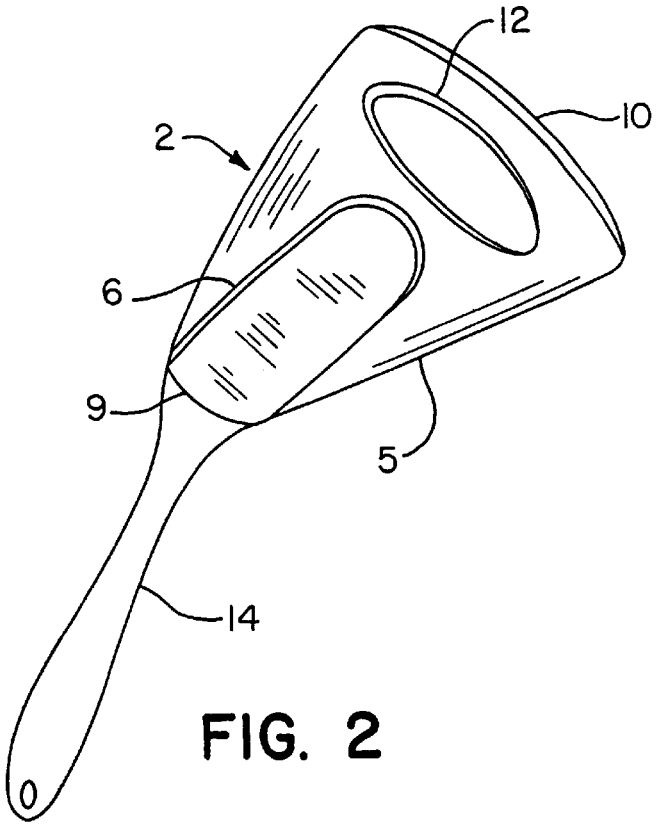
FIG. 2 is a perspective bottom view of a can cleaning device having a handle and bottle opener for use with a moist towelette.

Embodiments of cleaning device 2 contain a bottle opener 12 which is cut from main body 5 as shown in FIGS. 2, 3, and 4. Embodiments of cleaning device 2 also have a channel 6 cut into the bottom of main body 5 to fit over a pull tab 21 on the top of can 20 as best shown in FIGS. 2, 3 and 4. Perpendicular wall 10 may be used as a tab puller by inserting perpendicular wall 10 under tab 21 on the top of can 20 and pulling upward.

Can cleaning device 2 can be made of any type of solid or flexible material including wood, metal, plastic or similar suitable material. Preferred embodiments are light in weight and small for ease of carrying and use.

Referring to FIGS. 3, 4 and 5, can cleaning device 2 is intended for use with a towelette. The term towelette as used herein generally includes any napkin, paper towel, tissue, fabric, cloth or similar material. Can cleaning device 2 is used by placing a moist towelette 25, or similar clean material, on top of can 20 and next placing can cleaning device 2, or similar cleaning implement, over moist towelette 25 while guiding wall 10 down into groove 22 of can 20. Pull tab 21 on top of can 20 fits into channel 6 of can cleaning device 2. Once properly in place, can cleaning device 2 is manipulated by applying pressure with one's thumb downward onto main body 5 and rotating can cleaning device 2 back and forth until the top and groove 22 of can 20 are clean. Embodiments of can cleaning device 2 having handle 14 or key ring 18 provide an additional appendage for grasping with one's fingers and palm while applying pressure with one's thumb and rotating can cleaning device 2. After the surface has been cleaned the soiled moist towelette 25, napkin, paper towel, tissue or similar material may then be properly discarded.

Figure 6:
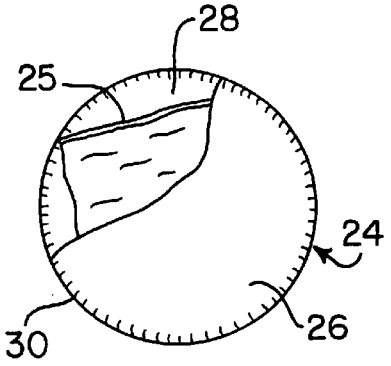
FIG. 6 is a cut away perspective view of a packaged moist towelette made according to the invention.

Although can cleaning device 2 can be used with a napkin, paper towel, tissue or similar readily available clean material, best results in cleaning the top and groove 22 of can 20 are obtained by using moist towelette 25 as shown in FIGS. 5 and 6. Moist towelette 25 is best suited for cleaning the top and groove 22 of can 20 where it is moistened with a liquid designed to enhance the removal of dirt or reduce germs and bacteria on the surfaces and groove to be cleaned. A can 20 cleaned with moist towelette 25, moistened with an appropriate cleaning or disinfecting solution, provides a more sanitary surface from which a consumer can directly ingest liquids.

Although packaged moist towelettes are known in the prior art, none are designed for use on pop top cans or for use with a can cleaning device. Prior art packaged moist towelettes are heavily perfumed and contain lotions and cleaning solvents in concentrations which are not suitable for use on pop top cans which often come into direct contact with a consumer's mouth. The odor and taste of perfumes, lotions and cleaning solvents used in prior art moist towelettes makes their use to clean pop top cans undesirable, especially where the odor and taste of the residue left on the can would detract from enjoyment of the beverage when consumed directly from the can.

Moist towelette 25 can be made of any material which resists tearing when manipulated with cleaning device 2 or similar cleaning implement. The preferred embodiment of moist towelette 25 is moistened with a liquid capable of assisting in the removal of dirt and debris from groove 22, or in disinfecting or sanitizing any surface and groove 22 on the top of can 20.

The liquid used to moisten the preferred embodiment of moist towelette 25 should not present an objectionable odor or taste after it is applied to can 20. The liquid may be water alone however, the preferred embodiment is water with a sanitizer, anti-bacterial, or anti-germ agent. The concentration of sanitizer, anti-bacterial, or anti-germ agent should be sufficient to reduce contamination, germs and bacteria on the top surface and groove 22 of can 20 without leaving a persistent residue with a perceptible taste or odor after using moist towelette 25 to clean can 20.

Many commonly available sanitizers, detergents, anti-bacterial, or anti-germ agents contain no perfumes, are non-toxic in small concentrations and have no perceptible taste or odor in small concentrations. One example is the sanitizer H-101, produced by Hillyard, Inc., which is clear, does not have an objectionable odor in small concentrations, contains no perfumes and is formulated for cleaning and sanitizing surfaces that come in contact with food or beverages. The sanitizer H-101, or similar sanitizers, may be added to water in small concentrations and the solution used to moisten towelette 25. A solution of water with a concentration of less than 10 percent by weight sanitizer is suitable for wiping the top surface and groove 22 of can 20. A preferred embodiment contains 99 percent water by weight and 1 percent sanitizer such as H-101.

An example of an anti-bacterial and anti-germ agent which is non-toxic in small concentrations and has no perceptible taste or odor in small concentrations is the chemical agent benzalkonium chloride. Benzalkonium chloride, or similar agents, may be added to water in small concentrations and the solution used to moisten towelette 25. A solution of water with a concentration of less than 0.2 percent by weight benzalkonium chloride is suitable for wiping the top surface and groove 22 on can 20. A preferred embodiment has 99.93 percent water by weight and 0.07 percent benzalkonium chloride.

The solution used to moisten towelette 25 may also contain a surfactant and other ingredients such as a detergent, defoamer and preservatives so long as the additives are used in concentrations which are non-toxic and do not leave an objectionable odor or taste when applied to can 20.

Figure 7:
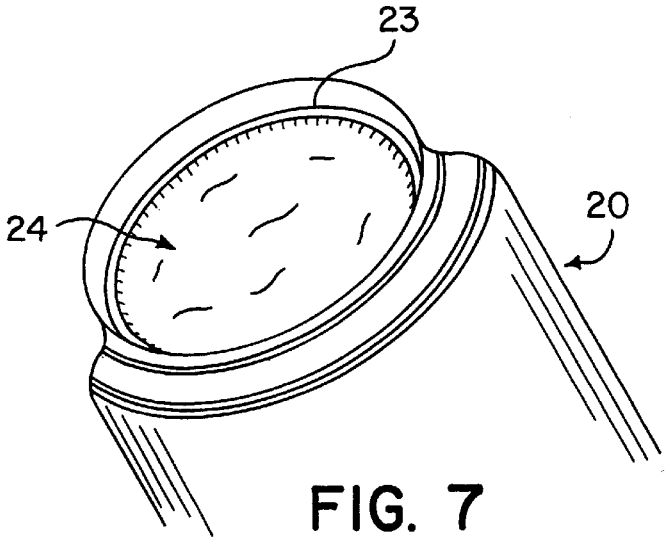
FIG. 7 is a perspective bottom view of a pop top can with a packaged moist towelette attached according to the invention.

Referring to FIGS. 6 and 7, moist towelette 25 may be stored in a packet 24 to preserve the towelette's moisture and cleanliness until the towelette is ready for use. Packet 24 has a packet top 26 and packet bottom 28. Moistened towelette 25 is placed between the packet top and packet bottom and sealed along packet edge 30. Packet 24 may be sealed air tight to prevent the escape of moisture from the towelette and to prevent contamination of the towelette. The preferred embodiment of moist towelette packet 24 is vacuum sealed.

Packet 24 may be any shape or size however, the preferred embodiment is generally round in shape. A generally round packet 24 can be attached to well 23 on the bottom of can 20, especially when packet 24 is circumferentially smaller than the outer wall of well 23 as can best be seen in FIG. 7. Packet 24 can be attached to any part of can 20 with double sided tape, glue, or any other method of attachment. Attaching packet 24 to can 20 provides a convenient means of dispensing the moist towelette packet from vending machines along with the beverage can. Can cleaning device 2 can be attached to a vending machine with a chain or cable for immediate use with moist towelette 25 in packet 24 when can 20 is dispensed from the vending machine.

Although only specific embodiments of the present invention are shown and described herein, the invention is not limited by these embodiments. Rather, the scope of the invention is to be defined by these descriptions taken together with the attached claims and their equivalents.

What is claimed is:

1. A method of cleaning a top surface and a circumferential groove on the top of a pop top beverage can using a disposable moist towelette, said method comprising the steps of:

a) storing a moist towelette in a sealed disposable packet, said moist towelette comprising a cleaning means for cleaning the circumferential groove on the top of a pop top beverage can wherein said cleaning means is selected from the group comprising a napkin, paper towel, tissue, fabric, and cloth, such that said cleaning means resists tearing when applying pressure to said cleaning means by a can cleaning device and rotated relative to said circumferential groove for cleaning said groove on said can; and a moistening means for moistening said cleaning means and sanitizing said circumferential groove on the top of said can wherein said moistening means comprises water and a sanitizing means for sanitizing said circumferential groove on the top of said can where said sanitizing means does not leave a residue on said can and has no perceptible odor and taste after using said cleaning means moistened with said moisturizing means to clean and sanitize said circumferential groove;

b) removing said moist towelette from said packet;

c) placing said moist towelette on the top of said beverage can;

d) forcing a portion of said moist towelette into said groove on the top of said beverage can; and e) applying pressure to said moist towelette while manipulating said moist towelette to clean the top surface and groove on said can.

2. The method of claim 1, wherein said towelette is vacuum sealed in said packet.

3. The method of claim 1, wherein said packet containing said moist towelette is attached to a pop top beverage can, the method including the step of removing said packet from said pop top beverage can.

4. The method of claim 3 wherein said pop top beverage can with said packet attached is stored, the method including the step of dispensing said pop top beverage can with said packet attached.

* * * * *